US007708649B2

(12) United States Patent
Maraschiello

(10) Patent No.: US 7,708,649 B2
(45) Date of Patent: May 4, 2010

(54) METHOD AND APPARATUS FOR GOLF SWING ALIGNMENT

(76) Inventor: Victor A. Maraschiello, 27 Cameo Dr., Flat Rock, NC (US) 28731

( * ) Notice: Subject to any disclaimer, the term of this patent is extended or adjusted under 35 U.S.C. 154(b) by 24 days.

(21) Appl. No.: 11/799,580

(22) Filed: May 2, 2007

(65) Prior Publication Data

US 2007/0259729 A1 Nov. 8, 2007

Related U.S. Application Data

(60) Provisional application No. 60/798,391, filed on May 8, 2006.

(51) Int. Cl.
*A63B 69/36* (2006.01)

(52) U.S. Cl. ..... 473/257; 473/265

(58) Field of Classification Search ..... 473/218, 473/257, 260, 261, 262, 264, 265, 266, 270, 473/278

See application file for complete search history.

(56) References Cited

U.S. PATENT DOCUMENTS 3,482,838 A * 12/1969 Gibson et al. ..... 473/264
3,570,376 A * 3/1971 Overton et al. ..... 52/38
3,753,563 A * 8/1973 Previte, Jr. ..... 473/265
3,870,315 A * 3/1975 Lawlor et al. ..... 473/264
4,453,717 A * 6/1984 Solheim et al. ..... 473/265
4,620,708 A * 11/1986 Meyer et al. ..... 473/265
4,927,152 A * 5/1990 Graham ..... 473/265
5,014,994 A * 5/1991 Peters ..... 473/218
5,131,659 A * 7/1992 Lindberg, Jr. ..... 473/267
5,246,233 A * 9/1993 Sheltman et al. ..... 473/265
5,350,177 A 9/1994 Furbush, Jr.
5,464,220 A * 11/1995 Hansen et al. ..... 473/218
5,848,502 A * 12/1998 Schaefer ..... 52/165
5,855,523 A 1/1999 Hatchett
6,019,685 A * 2/2000 Fonseca et al. ..... 473/265
6,099,203 A * 8/2000 Landes ..... 404/10
6,840,870 B1 * 1/2005 Froggatte ..... 473/265

* cited by examiner

*Primary Examiner*—Nini Legesse
(74) *Attorney, Agent, or Firm*—Michaelson & Associates; Peter L. Michaelson; Aubrey Helms, Jr.

(57) ABSTRACT

The present invention relates generally to the field of training aids and methods for the development and improvement of a proper golf swing. Specifically, the present invention relates to training aids and methods for the development of proper golf swings that aid the student in learning the proper swing mechanics for hitting golf shots straight, hitting golf shots that curve slightly to the right, and hitting golf shots that curve slightly to the left. The training aid may be used to improve golf shots used during full shots, putting, pitching, and chipping. The present invention may be well suited for beginning players to teach proper techniques.

16 Claims, 7 Drawing Sheets

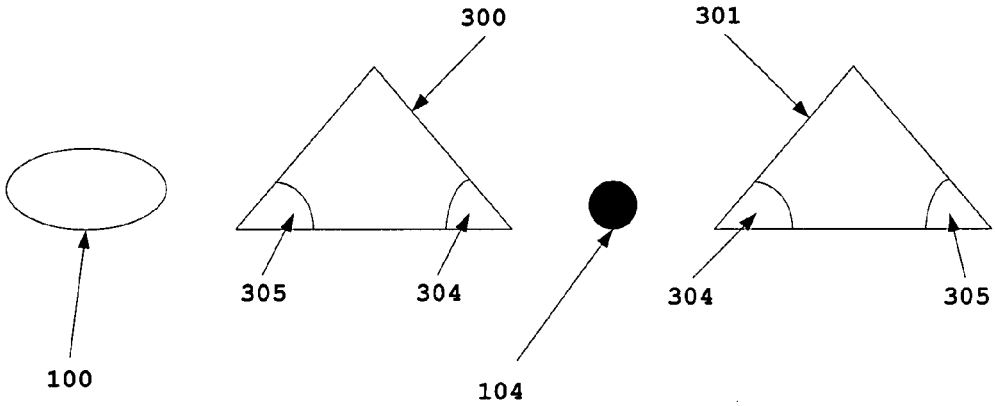
FIG. 3-A
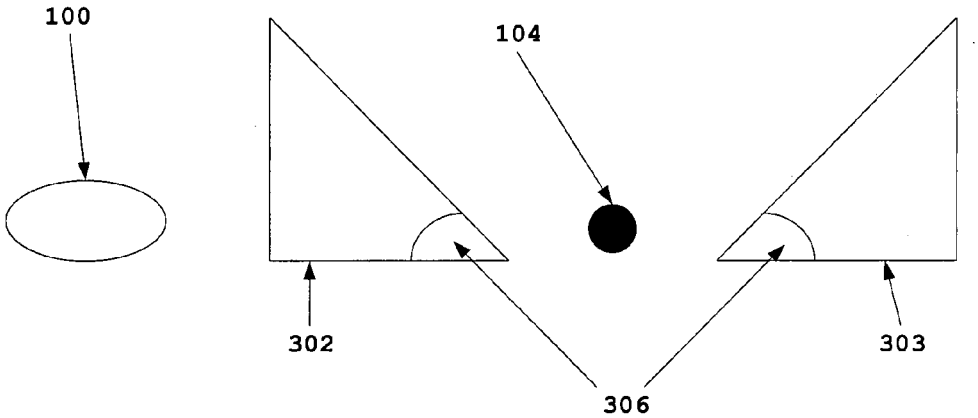
FIG. 3-B
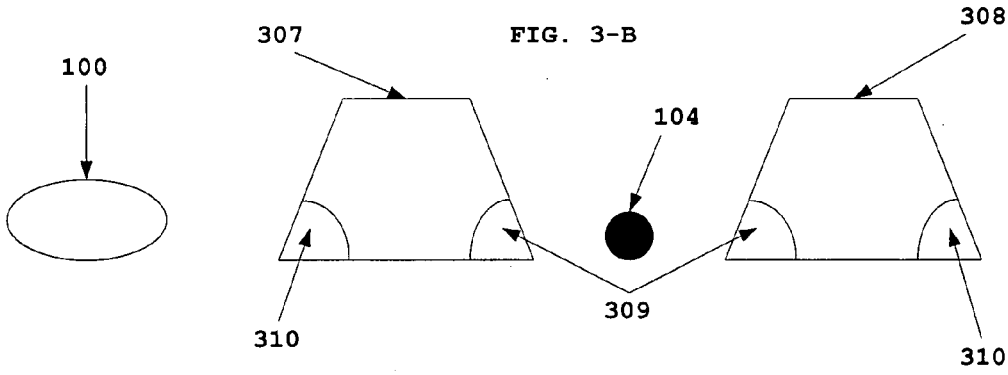
FIG. 3-C

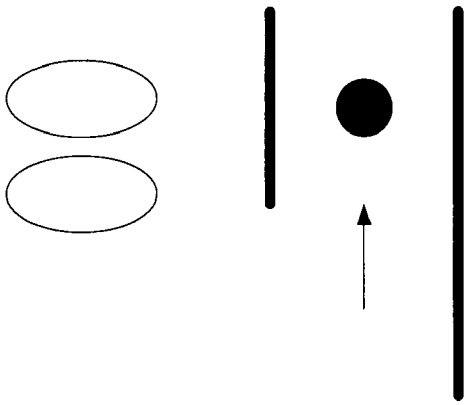
FIG. 4-A
(Straight
Swing)
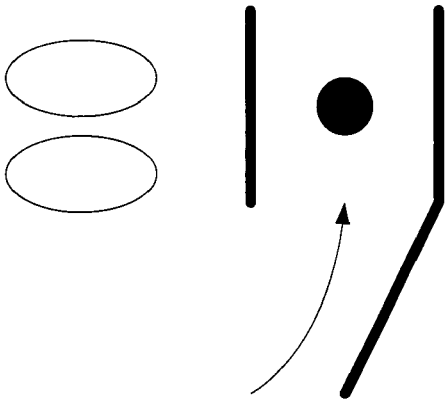
FIG. 4-B
(Draw Swing)
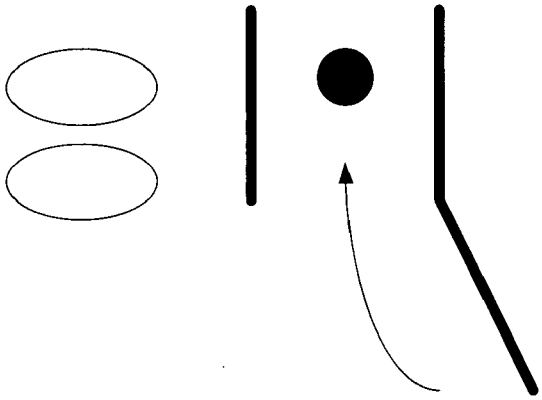
FIG. 4-C
(Fade Swing)
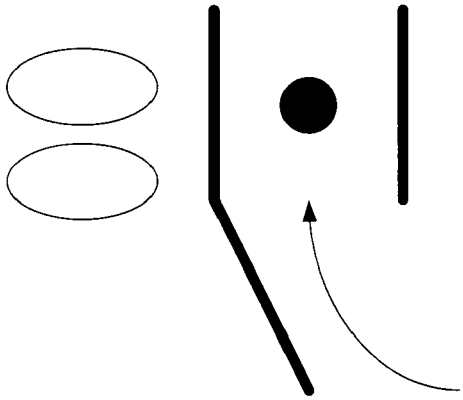
FIG. 4-D
(Fade Swing)

(Alignment Mat)

(Putting, Chipping, Pitching)

METHOD AND APPARATUS FOR GOLF SWING ALIGNMENT

CROSS-REFERENCE TO RELATED APPLICATIONS

This application claims priority under 35 U.S.C. §119 (e) to the following U.S. provisional application Ser. No. 60/798,391 filed on May 8, 2006 which is hereby incorporated by reference in its entirety.

FIELD OF THE INVENTION

The present invention relates generally to the field of training aids and methods for the development and improvement of a proper golf swing. Specifically, the present invention relates to training aids and methods for the development of proper golf swings that aid the student in learning the proper swing mechanics for hitting golf shots straight, hitting golf shots that curve slightly to the right, and hitting golf shots that curve slightly to the left. Additionally, the present invention relates to training aids that serve to improve hand position, ball placement position, golfer posture, and golfer alignment when preparing to hit the golf ball.

BACKGROUND OF THE INVENTION

The golf swing is a complex athletic movement that is difficult to master. Small errors in grip, set-up, alignment, swing path, swing plane, and tempo, among others may produce large errors in the flight of the ball. Players at all levels must continuously practice and develop good swing mechanics to excel at the game. Indeed, even professional players spend a large amount of time and money perfecting their swing mechanics to improve their skill.

The trajectory of the golf ball may be largely determined by the relative angle of the face of the golf club and the target line and by the swing path as the golf club approaches the ball. A shot that starts down the target line and curves slightly to the right is termed a "fade" (for right handed golfers). A shot that starts down the target line and curves dramatically to the right is termed a "slice" (for right handed golfers). A shot that starts down the target line and curves slightly to the left is termed a "draw" (for right handed golfers). A shot that starts down the target line and curves dramatically to the left is termed a "hook" (for right handed golfers). Many players assume that the goal of the perfect golf swing is to hit a straight shot, that is, the golf ball follows a path that is substantially directly down the target line. However, this is rarely the case. Even professional players have developed skills where they can "work" the ball. "Working" the ball means they can hit a fade or a draw at will to make the ball curve slightly right or left by altering their swing mechanics. It is often advantageous to have the ball approach the hole on a curved trajectory rather than a straight trajectory.

There are golf swing training aids that attempt to teach the student proper swing mechanics. These training aids may have one or more of the following disadvantages comprising high complexity, large size, cumbersome, not portable, high cost, requirement for electrical power, and the like. Many of these golf swing training aids do not have the ability to teach the student a variety of golf swing mechanics. They focus on teaching the student the proper swing to hit the golf ball substantially straight down the target line.

Therefore, a need exists in the art for an apparatus and methods to teach students the proper golf swing mechanics so that they can hit a variety of golf shots consistently and with high accuracy.

SUMMARY OF THE INVENTION

Accordingly and advantageously some embodiments of the present invention provide methods and apparatuses that aid the student in learning the proper swing mechanics for hitting golf shots straight, hitting golf shots that curve slightly to the right, and hitting golf shots that curve slightly to the left. Additionally, some embodiments of the present invention provide apparatuses and methods that aid the student in learning the proper swing mechanics for proper pitching, chipping, and putting technique. Additionally, some embodiments of the present invention provide apparatuses and methods that aid the student in learning the proper golf ball placement, proper posture, proper distance from the golf ball, and proper hand placement, among others.

These and other advantages are achieved in accordance with the present invention as described in detail below.

BRIEF DESCRIPTION OF THE DRAWINGS

To facilitate understanding, identical reference numerals have been used, where possible, to designate identical elements that are common to the figures. The drawings are not to scale and the relative dimensions of various elements in the drawings are depicted schematically and not to scale.

The techniques of the present invention can readily be understood by considering the following detailed description in conjunction with the accompanying drawings, in which:

FIG. 3 is a schematic representation of some of the possible cross-sectional shapes of some embodiments of the present invention.

FIG. 4 is a schematic representation of some of the possible alignment configurations of some embodiments of the present invention.

DETAILED DESCRIPTION OF THE INVENTION

Figure 1:
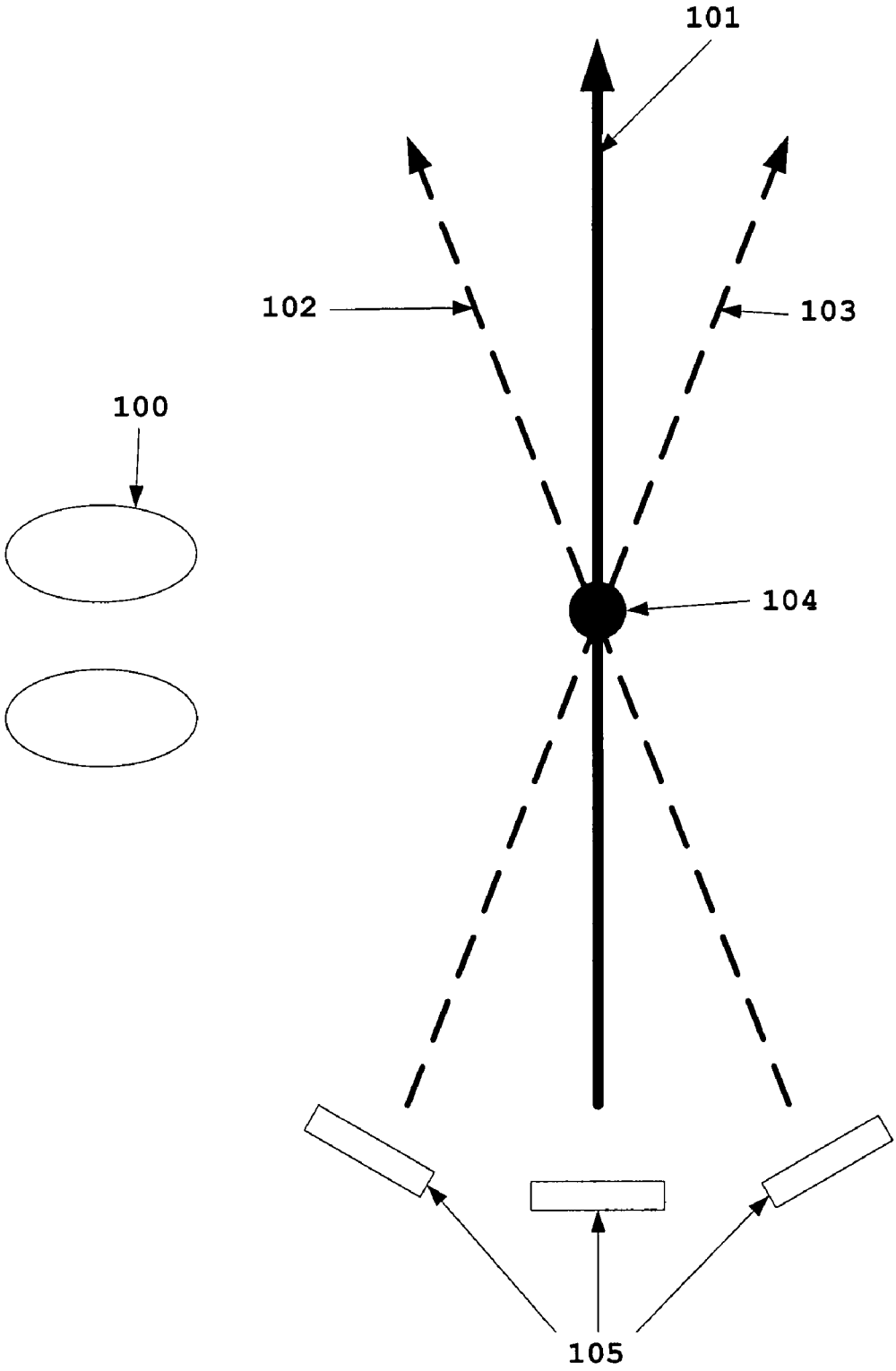
FIG. 1 is a schematic representation of the coordinate system used in the description of some embodiments of the present invention.

After considering the following description, those skilled in the art will clearly realize that the teachings of the present invention may be readily utilized in the teaching of the proper swing mechanics for hitting a golf ball. Referring now to FIG. 1, the position of the player is indicated by the placement of the feet, 100. For economy of language, the teachings of the present invention will be described for a right-handed player. It will be understood by those skilled in the art that the teachings of the present invention are equally applicable to left-handed players. The center arrow, 101, indicates the target line. That is, it indicates a line drawn between the golf ball, 104, and the target (not shown). This also indicates one possible path along which the club head, 105, may follow as it approaches the golf ball. This path may be termed a "straight" swing and may produce a straight trajectory. The dotted arrow, 102, indicates one possible path along which the club head, 105, may follow as it approaches the golf ball. This path may be termed an "outside-in" swing and may produce a fade or a slice trajectory as described previously. The dotted arrow, 103, indicates another possible path along which the club head, 105, may follow as it approaches the golf ball. This path may be termed an "inside-out" swing and may produce a draw or a hook trajectory as described previously.

Figure 2:
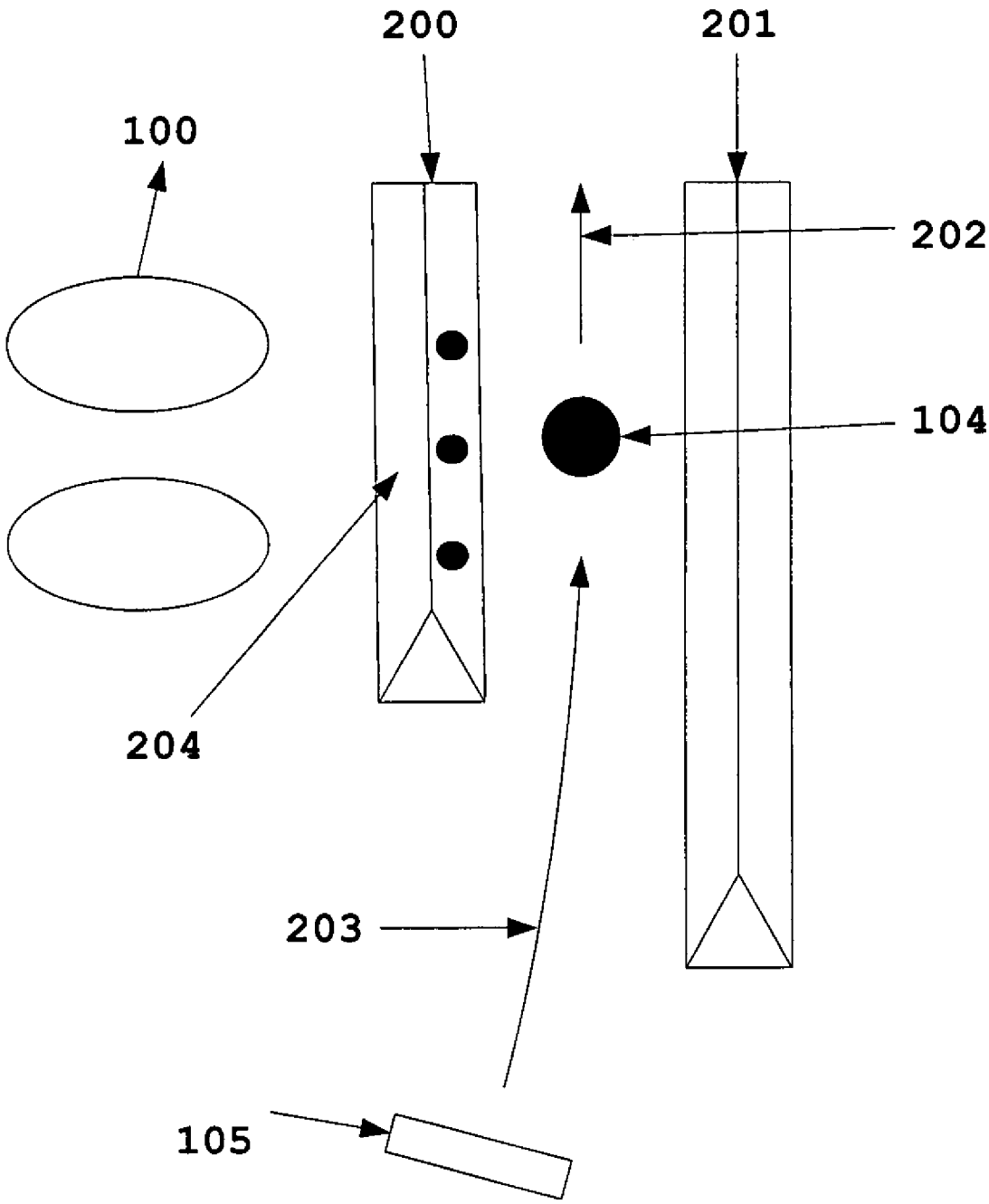
FIG. 2 is a schematic representation of some embodiments of the present invention.

Referring now to FIG. 2, in some embodiments of the present invention, the apparatus may comprise a first alignment member, 200, positioned closest to the player, 100, and a second alignment member, 201, positioned farther away from the player. The two alignment members may have a vertical height ranging from about 1 inch to about 8 inches. It may be advantageous for the two alignment members to have a vertical height of about 4 inches. The two alignment members may be positioned so that a channel is formed between them. The golf ball, 104, is positioned between the two alignment members inside the channel. The channel formed by the two alignment members may be advantageously aligned along the imaginary line that extends from the golf ball to the intended target. Thus, the alignment members may assist the player in their initial alignment so that the golf ball may be struck accurately toward the intended target.

The two alignment members may have a means for attaching small alignment markers, 204, to the members. The alignment markers serve to give the player visual clues for placement of the ball and placement of the feet. The attachment means may comprise snaps, buttons, magnets, VELCRO, tacks, adhesive tape, screws, nails, and combinations thereof, among others. The alignment markers may be the same color or may be different colors. The alignment markers may additionally comprise alphanumeric characters. Exemplary alphanumeric characters comprise "L", "LF", "R", "RF", "B", and the like. In this example, ""L" and "LF" might refer to the marker indicating the position of the left foot. In this example, ""R" and "RF" might refer to the marker indicating the position of the right foot. In this example, ""B" might refer to the marker indicating the position of the ball. Thus, the markers may assist the player in the proper placement of their feet and the proper placement of the golf ball in a relative position. These alignment markers may serve to reinforce proper set-up and placement through repetitive use.

In some embodiments of the present invention, first alignment member, 200, may be shorter than second alignment member, 201. The length of the first alignment member, 200, may range from about 6 inches to about 24 inches. The length of the second alignment member, 201, may range from about 6 inches to about 36 inches. This allows a space for the club head, 105, to enter the channel so that it does not hit the end of first alignment member, 200. In some embodiments of the present invention, first alignment member, 200, may be the same length as second alignment member, 201, and may be positioned in an off-set manner from the second alignment member such that the first alignment member extends farther toward the intended target. This allows a space for the club head, 105, to enter the channel so that it does not hit the end of first alignment member, 200. The length of first alignment member, 200, and second alignment member, 201, may advantageously be about 18 inches and thus may be about equal to the proper stance width of a typical golfer.

Referring now to FIG. 3-A, the cross section of the two alignment members, 300, 301, may be a triangle. In some embodiments of the present invention, the interior angles (closest to the golf ball), 304, may be equal and may vary from 30 to 70 degrees. Typically, it may be advantageous for the interior angles, 304, to be about 50 to 60 degrees so that they approximate the standard angle between typical golf club shafts and the sole of the club head. In some embodiments of the present invention, it may be advantageous for the interior angles, 304, to be about 45 degrees. In some embodiments of the present invention, the interior angles, 304, for the two alignment members, 300 and 301, may be different. As an example, the interior angle for alignment member, 300, may be set to about 50 degrees. This may be best suited for practice using a long club such as a driver or fairway wood. The interior angle for alignment member, 301, may be set to about 55 degrees. This may be best suited for practice using a short club such as an iron. In this way, the two alignment members may be provided as a set and the player may select the alignment member with the appropriate angle for the club they are using for practice and use that alignment member to form the side of the channel closest to their feet. The alignment members may be marked with a designation that indicates that they are intended for practice for wood or iron clubs.

Figure 7:
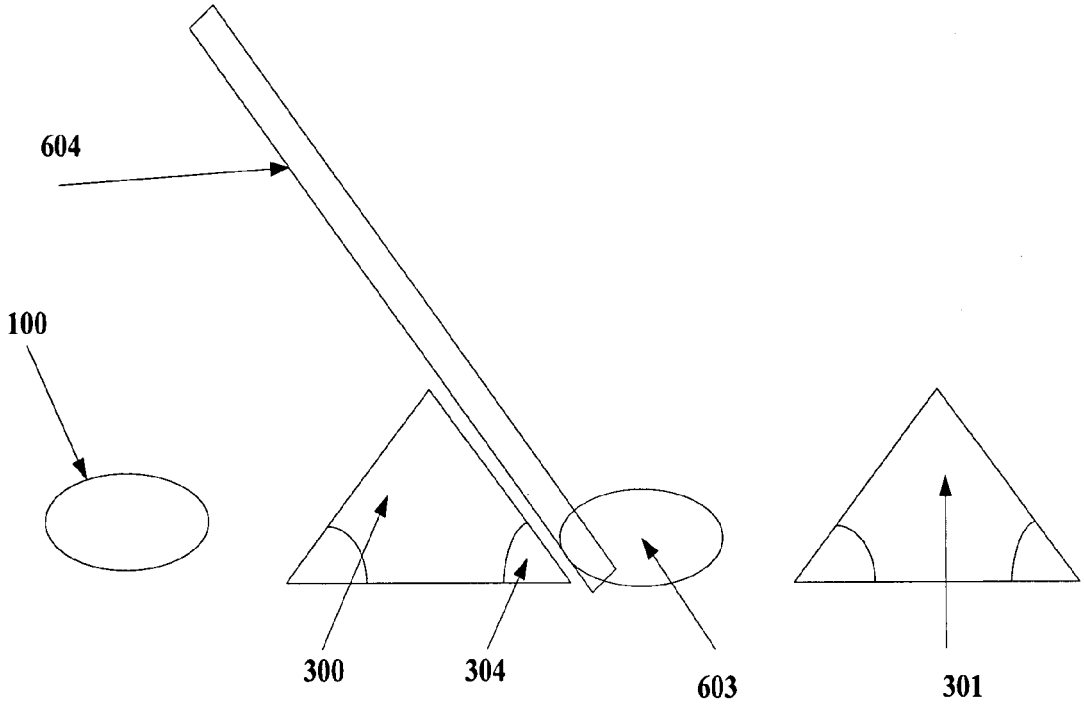
FIG. 7 is an illustrative representation of the shaft 604 and club head 603 in the proper position for checking the angle that may be used with some embodiments of the present invention.

In some embodiments of the present invention, the first alignment member (closest to the player) may be used to ensure that the player is standing the proper distance from the golf ball, has the proper grip, and exhibits good posture. The interior angle, 304, may be advantageously set to about the same as the standard angle made between the shaft of the club and the ground when the club is in the proper position for striking the golf ball. The player may check this angle by taking a small step backward and allowing the shaft of the club to lightly touch the interior angle, 304, of the first alignment member. This is illustrated in FIG. 7. In FIG. 7, the shaft 604 and club head 603 are illustrated in the proper position for checking the angle. This ensures that the club is held properly and the hands are in the proper position. The player may then step forward and align the club head with the golf ball and maintain the proper angle.

If the player is standing too close to the ball, the club head may strike the outer alignment member during the swing. This will give the player instant feedback that an error has been made. Similarly, if the player is standing too far from the ball, the club head may strike the inner alignment member during the swing. Again, this will give the player instant feedback that an error has been made. If the player is holding the club with their hands in the wrong position, they will not be able to maintain the proper angle between the shaft of the club and the ground. This can be easily verified by resting the shaft of the club along the interior angle of the first alignment member. This gives the player instant feedback on their hand position. Similarly, if the player is exhibiting poor posture, they will not be able to maintain the proper angle between the shaft of the club and the ground. This can be easily verified by resting the shaft of the club along the interior angle of the first alignment member. This gives the player instant feedback on their posture.

In some embodiments of the present invention, the exterior angles (farthest from the golf ball), 305, may be equal and may vary from 30 to 70 degrees. Typically, it may be advantageous for the exterior angles, 305, to be about 50 to 60 degrees. In some embodiments of the present invention, it may advantageous for the exterior angles, 305, to be about 45 degrees.

In some embodiments of the present invention, it may be advantageous for the interior angles, 304, and the exterior angles, 305, to be equal to each other and may vary from 30 to 70 degrees. Typically, it may be advantageous for the interior angles, 304, and the exterior angles, 305, to be equal to each other and to be about 50 to 60 degrees. Typically, it may be advantageous for the interior angles, 304, and the exterior angles, 305, to be equal to each other and to be about 45 degrees.

In some embodiments of the present invention, it may be advantageous for the interior angles, 304, and the exterior angles, 305, to be different from each other and may vary from 30 to 70 degrees. Typically, it may be advantageous for the interior angles, 304, to be about 50 to 60 degrees and the exterior angles, 305, to be about 55 degrees. This may allow the different sides of the triangle to be customized for use with "woods" or "irons" which typically have slightly different angles between the club head shaft and the club head. As discussed previously, the player would simply have to turn the two alignment members around so that the proper angle was on the interior portion of the channel.

Referring now to FIG. 3-B, the cross section of the two alignment members, 302, 303, may be a right triangle positioned such that the right angle is farthest from the golf ball. In some embodiments of the present invention, the interior angles (closest to the ball), 306, may be equal and may vary from 30 to 70 degrees. Typically, it may be advantageous for the interior angles, 306, to be about 50 to 60 degrees so that they approximate the standard angle between typical golf club shafts and the sole of the club head. In some embodiments of the present invention, it may be advantageous for the interior angles, 306, to be about 45 degrees.

Referring now to FIG. 3-C, the cross section of the two alignment members, 307, 308, may be a trapezoid. In some embodiments of the present invention, the interior angles (closest to the golf ball), 309, may be equal and may vary from 30 to 70 degrees. Typically, it may be advantageous for the interior angles, 309, to be about 50 to 60 degrees so that they approximate the standard angle between typical golf club shafts and the sole of the club head. In some embodiments of the present invention, it may be advantageous for the interior angles, 309, to be about 45 degrees.

In some embodiments of the present invention, the exterior angles (farthest from the golf ball), 310, may be equal and may vary from 30 to 90 degrees. Typically, it may be advantageous for the exterior angles, 310, to be about 50 to 60 degrees. In some embodiments of the present invention, it may advantageous for the exterior angles, 310, to be about 45 degrees.

In some embodiments of the present invention, it may be advantageous for the interior angles, 309, and the exterior angles, 310, to be equal to each other and may vary from 30 to 70 degrees. Typically, it may be advantageous for the interior angles, 309, and the exterior angles, 310, to be equal to each other and to be about 50 to 60 degrees. Typically, it may be advantageous for the interior angles, 309, and the exterior angles, 310, to be equal to each other and to be about 45 degrees.

In some embodiments of the present invention, it may be advantageous for the interior angles, 309, and the exterior angles, 310, to be different from each other and may vary from 30 to 70 degrees. Typically, it may be advantageous for the interior angles, 309, to be about 50 degrees and the exterior angles, 310, to be about 55 degrees. This may allow the different sides of the triangle to be customized for use with "woods" or "irons" which typically have slightly different angles between the club head shaft and the club head. The player would simply have to turn the two alignment members around so that the proper angle was on the interior portion of the channel.

In some embodiments of the present invention, the two alignment members are manufactured from inexpensive, lightweight, materials comprising cardboard, foam rubber, plastic, rubber, recycled materials, and the like. Typically, the alignment members may be manufactured from foam rubber. The materials may be chosen so that if the club head strikes either of the alignment members during the action of the swing, the club head will not be damaged and the player's hands, wrists, arms, shoulders, and the like will not be damaged or injured. The two alignment members may be flexible so that they may be shaped to teach the player a variety of golf swing mechanics.

Referring now to FIG. 4-A, in some embodiments of the present invention, the two alignment members may be aligned parallel to each other and parallel to the target line (not shown). This may teach the player the proper swing mechanics to produce a substantially straight trajectory. The club head may approach the golf ball along a path that is substantially coincident with the target line as indicated by the arrow. If the swing path is incorrect, the club head may strike one of the two alignment members. Thus, the player may receive instant feedback on the error and may concentrate on correcting the error. As an example, if the goal is to hit the golf ball with a substantially straight trajectory. If the player strikes the first alignment member (closest to the player), then the player knows that the club head is following an inside-to-outside trajectory instead of the desired straight trajectory. Therefore the player may alter their swing mechanics to correct the error. Likewise, if the player strikes the second alignment member (farthest from the player), then the player knows that the club head is following an outside-to-inside trajectory instead of the desired straight trajectory. Therefore the player may alter their swing mechanics to correct the error.

Referring now to FIG. 4-B, in some embodiments of the present invention, the second alignment member may be shaped so that the club head must enter the channel from the inside in order to miss the second alignment member. This may teach the player the proper swing mechanics to produce a draw trajectory as described previously. The club head may approach the golf ball along a path that is substantially "inside-out" with respect to the target line as indicated by the arrow. As discussed previously, if the player strikes one of the alignment members, it provides the player with instant feedback regarding the error in their swing mechanics.

Referring now to FIG. 4-C, in some embodiments of the present invention, the second alignment member may be shaped so that the club head must enter the channel from the outside in order to miss the second alignment member. This may teach the player the proper swing mechanics to produce a fade trajectory as described previously. The club head may approach the golf ball along a path that is substantially "outside-in" with respect to the target line as indicated by the arrow. As discussed previously, if the player strikes one of the alignment members, it provides the player with instant feedback regarding the error in their swing mechanics.

Referring now to FIG. 4-D, in some embodiments of the present invention, the first and second alignment members switch positions. The second alignment member may be placed closest to the player. The second alignment member (now closest to the player) may be shaped so that the club head must enter the channel from the outside in order to miss the second alignment member. This may teach the player the proper swing mechanics to produce a fade trajectory as described previously. The club head may approach the golf ball along a path that is substantially "outside-in" with respect to the target line as indicated by the arrow. As discussed previously, if the player strikes one of the alignment members, it provides the player with instant feedback regarding the error in their swing mechanics.

Figure 5:
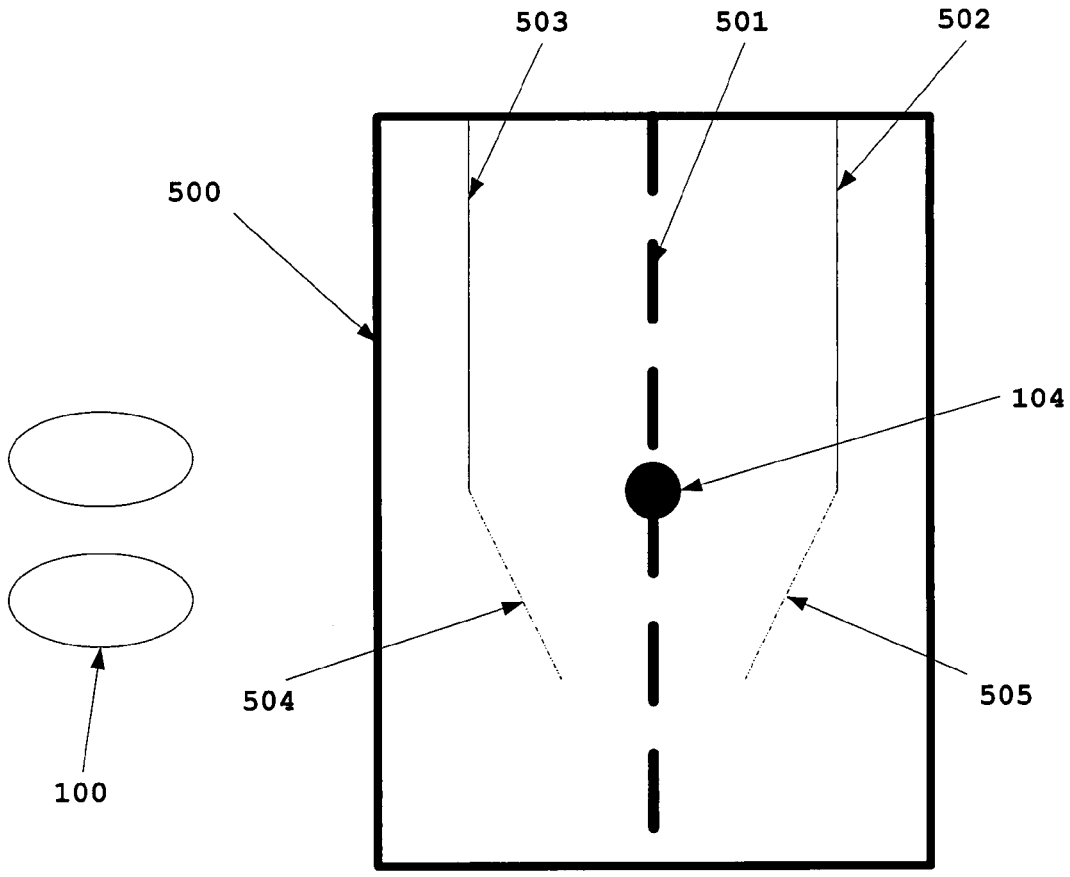
FIG. 5 is a schematic representation of an alignment mat that may be used with some embodiments of the present invention.

Referring now to FIG. 5, in some embodiments of the present invention, the apparatus includes an alignment mat, 500. The alignment mat may be manufactured from any of the well known artificial golf practice surfaces that are known in the art. The alignment mat comprises five alignment marks. A first alignment mark, the center alignment mark, 501, may serve as the target line. The center alignment mark may further comprise an indication for the proper placement of the golf ball, 104. First alignment mark, 501, may extend substantially the entire length of the mat. Second and fourth alignment marks, 503 and 502, may serve as the primary alignment marks for the two alignment members (not shown). These two alignment marks are substantially parallel to the first alignment mark, 501, and start at the golf ball position and extend toward the intended target. Third and fifth alignment marks, 504 and 505, may be used to shape the two alignment members so that the player may learn and practice hitting balls that curve to the right or left as previously described. Third alignment mark, 504, starts behind the golf ball near the first alignment mark, 501, and ends at end of the second alignment mark, 500, that is closest to the golf ball position. Fifth alignment mark, 505, starts behind the golf ball near the first alignment mark, 501, and ends at end of the fourth alignment mark, 501, that is closest to the golf ball position. The two alignment members may be simply placed on the alignment mat. Alternatively, the two alignment members may comprise attachment means for attaching the two alignment members to the alignment mat. The attachment means may comprise snaps, buttons, magnets, VELCRO, tacks, adhesive tape, screws, nails, combinations thereof, and the like.

In some embodiments of the present invention, the two alignment members may be positioned for the type of trajectory that the player would like to practice and reinforce. Initially, the channel may be made wide with several inches between each alignment member and the ball. As the player makes a full swing, if the swing mechanics are correct, the club head will not hit either of the alignment members. If the swing mechanics are not correct, the club head may impact one of the two alignment members. The player may receive immediate feedback regarding the proper swing mechanics. As the player's skill improves and the player can consistently make the proper swing without hitting either of the alignment members, the two alignment members may be moved close together to form a narrower channel. Repeated use of the present invention may reinforce good swing mechanics and may improve the skill of the player through so called "muscle memory". That is, the player may be able to reproduce the proper swing mechanics through subconsciously visualizing the alignment members under actual playing conditions without having to consciously think about the various details of the swing.

Figure 6:
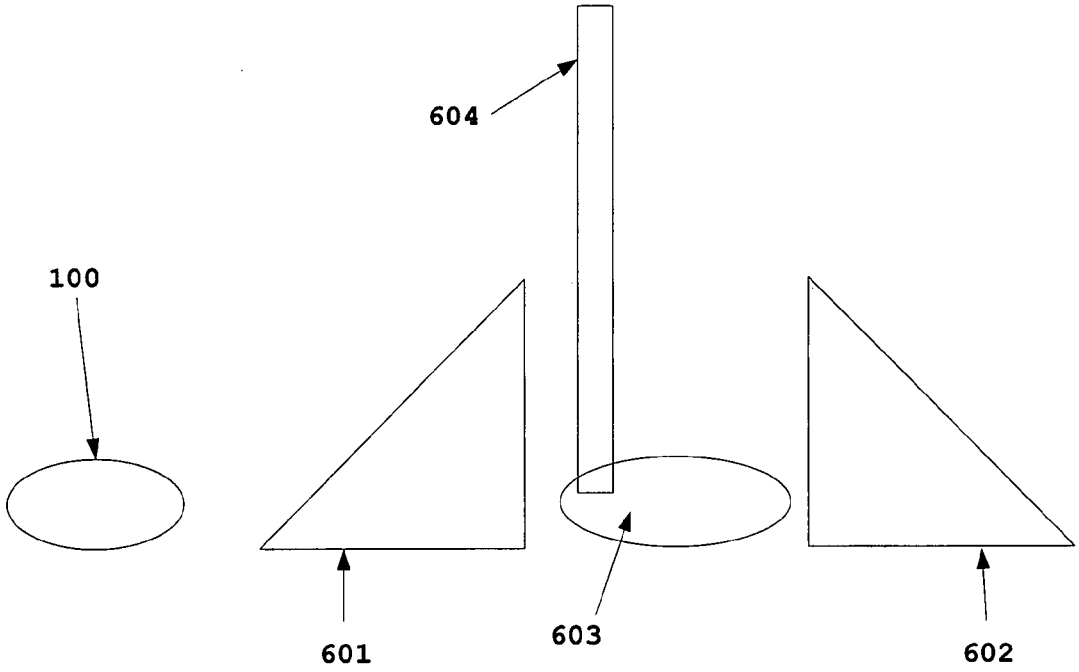
FIG. 6 is a schematic representation of an alignment mat that may be used with some embodiments of the present invention.

In some embodiments of the present invention, the two alignment members may be positioned for improving the skill of the player in the act of putting, pitching, or chipping. Those skilled in the art will recognize the usual definitions of a chipping and pitching as being shorter shots used when close to the green. These strokes typically require an upright stance where the shaft angle may be closer to 90 degrees. The two alignment members may be placed on the practice area parallel to each other so that a straight channel is formed as in FIG. 4-A. A view from behind the golf ball, looking toward the target is illustrated in FIG. 6. The golf ball is hidden by the club head, 603. The golf club shaft, 604, is shown to be substantially vertical. In the embodiment illustrated in FIG. 6, the alignment members, 601, 602, have been rotated so that the exterior sides are now forming the interior walls of the channel. In the embodiment illustrated, the angles of the triangle used to form the channel walls are shown as 90 degrees. However, this is not a requirement; the angles may be any angle between 30 and 70 degrees as discussed earlier. As with the full swing, the channel may be made large at first until the skill of the player increases. As the player's skill improves and the player can consistently make the proper swing without hitting either of the alignment members, the two alignment members may be moved close together to form a narrower channel.

Some embodiments of the present invention may be well suited for teaching the proper swing mechanics to beginning players. As previously discussed, the golf swing is a complex athletic movement. The proper golf swing may be influenced by many factors comprising posture, proper hand position, proper golf ball placement, the distance from the player to the golf ball, and club head trajectory, among others. The use of some embodiments of the present invention may give the player instant feedback on errors in one or more of these factors. It may be difficult for a beginning player to appreciate and master all of these factors during initial practice sessions. The use of some embodiments of the present invention may ensure that the beginning player learns and repeats proper techniques regarding these factors. In this way, the beginning player may quickly learn to strike the golf ball solidly and along the proper trajectory. This may increase the beginning player's confidence and enjoyment of the sport and reinforce additional practice and learning.

Although various embodiments which incorporate the teachings of the present invention have been shown and described in detail herein, those skilled in the art can readily devise many other varied embodiments that still incorporate these teachings.

What is claimed is:

1. An apparatus for golf swing training comprising:

a first elongate member and a second elongate member positioned upon a golf ball hitting surface so as to form a channel therebetween;

a golf ball located in the channel;

wherein the channel is aligned along a direction from the golf ball towards a target towards which the golf ball is desired to travel when properly struck by a golfer;

wherein the first elongate member and the second elongate member each have a triangular cross-section perpendicular to their longitudinal axes, each triangular cross-section having three interior angles;

wherein the first elongate member and second elongate member each have a height of about 4 inches measured from the golf ball hitting surface upon which the elongate member is positioned;

wherein the first elongate member has a first interior angle between about 50 and about 60 degrees; and wherein the second elongate member has a first interior angle between about 50 and about 60 degrees.

2. An apparatus as in claim 1 wherein the first elongate member and the second elongate member have substantially the same length along their longitudinal axes.

3. An apparatus as in claim 2 wherein the lengths of the first elongate member and the second elongate member are each about 18 inches.

4. An apparatus as in claim 1 wherein the first elongate member and the second elongate member have different lengths along their longitudinal axes.

5. An apparatus as in claim 1 wherein the materials used to form the first elongate member and the second elongate member are selected from the group consisting of new or recycled cardboard, foam rubber, plastic, rubber, and mixtures and blends thereof.

6. An apparatus as in claim 1 wherein the first interior angle of the first elongate member is about 50 degrees and the first interior angle of the second elongate member is about 55 degrees.

7. An apparatus as in claim 6 wherein a second interior angle of the first elongate member is about 90 degrees; and a second interior angle of the second elongate member is about 90 degrees.

8. An apparatus as in claim 6 wherein at least two of the three interior angles are substantially equal in the first elongate member; and at least two of the three interior angles are substantially equal in the second elongate member.

9. An apparatus for golf swing training comprising:

a first elongate member and a second elongate member positioned upon a golf ball hitting surface so as to form a channel therebetween;

a golf ball located in the channel;

wherein the channel is aligned along a direction from the golf ball towards a target towards which the golf ball is desired to travel when properly struck by a golfer;

wherein the first elongate member and the second elongate member each have a trapezoidal cross-section perpendicular to their longitudinal axes, each trapezoidal cross-section having two base interior angles and two top interior angles;

wherein the first elongate member and second elongate member each have a height of about 4 inches measured from the golf ball hitting surface upon which the elongate member is positioned;

wherein the first elongate member has a first base interior angle between about 50 and about 60 degrees; and wherein the second elongate member has a first base interior angle between about 50 and about 60 degrees.

10. An apparatus as in claim 9 wherein the first elongate member and the second elongate member have substantially the same length along their longitudinal axes.

11. An apparatus as in claim 9 wherein the lengths of the first elongate member and the second elongate member are each about 18 inches.

12. An apparatus as in claim 9 wherein the first elongate member and the second elongate member have different lengths along their longitudinal axes.

13. An apparatus as in claim 9 wherein the materials used to form the first elongate member and the second elongate member are selected from the group consisting of new or recycled cardboard, foam rubber, plastic, rubber, and mixtures and blends thereof.

14. An apparatus as in claim 9 wherein the first base interior angle of the first elongate member is about 50 degrees and the first base interior angle of the second elongate member is about 55 degrees.

15. An apparatus as in claim 14 wherein a second base interior angle in the first elongate member is about 90 degrees; and a second base interior angle in the second elongate member is about 90 degrees.

16. An apparatus as in claim 14 wherein the two base interior angles are substantially equal in the first elongate member; and the two base interior angles are substantially equal in the second elongate member.

* * * * *